US006573484B1

(12) United States Patent
Yue

(10) Patent No.: US 6,573,484 B1
(45) Date of Patent: Jun. 3, 2003

(54) ELECTRICAL HEATING WIRE ASSEMBLY

(76) Inventor: Steven Yue, 4F, No. 7, Lane 180, Sec. 2, Yen-Chiu-Yuan Rd., Taipei City (TW)

( * ) Notice: Subject to any disclaimer, the term of this patent is extended or adjusted under 35 U.S.C. 154(b) by 0 days.

(21) Appl. No.: 10/105,146

(22) Filed: Mar. 25, 2002

(51) Int. Cl.[7] ..... H05B 3/00

(52) U.S. Cl. ..... 219/541; 174/849; 439/874

(58) Field of Search ..... 219/541, 542, 219/546, 548; 174/74 A, 75 R, 84 S, 88 R; 338/303, 240; 439/874; 361/284; 138/149

(56) References Cited

U.S. PATENT DOCUMENTS

| | | | | | |
|---|---|---|---|---|---|
| 3,721,749 | A | * | 3/1973 | Clabburn | 174/88 R |
| 3,761,857 | A | * | 9/1973 | Carlson et al. | 338/30 |
| 3,798,348 | A | * | 3/1974 | van Toorn | 174/84 S |
| 4,192,352 | A | * | 3/1980 | Hakamada et al. | 138/149 |
| 4,388,523 | A | * | 6/1983 | Keep, Jr. et al. | 219/541 |
| 4,412,270 | A | * | 10/1983 | Weitz, Jr. et al. | 361/284 |
| 4,523,177 | A | * | 6/1985 | Driggers | 338/303 |
| 4,763,102 | A | * | 8/1988 | Ritt | 338/240 |
| 5,944,567 | A | * | 8/1999 | Ratajczak et al. | 439/874 |
| 6,147,308 | A | * | 11/2000 | Santagata | 174/75 R |
| 6,204,488 | B1 | * | 3/2001 | Toya et al. | 219/541 |
| 6,359,226 | B1 | * | 3/2002 | Biddell et al. | 174/74 A |
| 2002/0162834 | A1 | * | 11/2002 | Asano | 219/541 |

FOREIGN PATENT DOCUMENTS

| | | | | |
|---|---|---|---|---|
| JP | 10106868 | * | 10/2001 | H01J/61/36 |

* cited by examiner

*Primary Examiner*—Teresa Walberg
*Assistant Examiner*—Leonid Fastovsky
(74) *Attorney, Agent, or Firm*—Trop, Pruner & Hu, P.C.

(57) ABSTRACT

An electrical heating wire assembly includes a heating wire with a bundle of electrical heating filaments, a conductive wire, and a connector interconnecting the heating wire and the conductive wire. The connector includes a conductive body that has a block portion formed with a recess which receives and which is electrically connected to the conductive wire, and a pin portion that projects from the block portion into the heating wire to contact the heating filaments. An insulator watertight sleeve is sleeved on the conductive body and ends of the heating wire and the conductive wire, with the pin portion extending outwardly through a terminating end of the sleeve. With the construction as such, heat at ends of the heating filaments, which are surrounded by the sleeve, is negligible.

7 Claims, 2 Drawing Sheets

ELECTRICAL HEATING WIRE ASSEMBLY

BACKGROUND OF THE INVENTION

1. Field of the Invention

This invention relates to an electrical heating wire assembly, more particularly to an electrical heating assembly that includes a connector interconnecting an electrical heating wire and an electrical conductive wire.

2. Description of the Related Art

The heating wire of an electrical blanket normally includes a bundle of conductive carbon filaments, and an insulator plastic sleeve that is sleeved on the bundle of the filaments. The heating wire is connected to a conductive wire, with a watertight sleeve sleeved on connected ends of the heating wire and the conductive wire so that the connected ends of the heating wire and the conductive wire can be isolated from water or moisture present in the atmosphere. The assembly of the conventional heating wire, the conductive wire, and the watertight sleeve is disadvantageous in that the watertight sleeve is vulnerable to deteriorate due to heat generated at the connecting end of the heating wire.

SUMMARY OF THE INVENTION

Therefore, it is an object of the present invention to provide an electrical heating assembly that is capable of overcoming the aforesaid drawback associated with the prior art.

Accordingly, an electrical heating wire assembly of this invention comprises: an electrical heating wire including a bundle of electrical heating filaments and an insulator sleeve that is sleeved on the heating filaments, the heating wire having a connecting end; an electrical conductive wire including a core and a protective sleeve that is sleeved on the core and that has a connecting end, the core having a connecting end that is exposed from the connecting end of the protective sleeve; and a connector interconnecting the heating wire and the conductive wire and including a conductive body and an insulator watertight sleeve. The conductive body includes a block portion that extends in a longitudinal direction and that has a conductive wire-connecting end, a heating wire-connecting end opposite to the conductive wire-connecting end, and a recess extending inwardly from the conductive wire-connecting end toward the heating wire-connecting end in the longitudinal direction. The recess receives and connected to the connecting end of the core of the conductive wire. The conductive body further includes a pin portion that is reduced in cross-section relative to the bock portion, that projects from the heating wire-connecting end in the longitudinal direction, and that is inserted into the insulator sleeve at the connecting end of the heating wire in the longitudinal direction. The insulator watertight sleeve extends in the longitudinal direction and is sleeved on the conductive body, the connecting end of the heating wire, and the connecting end of the protective sleeve so as to seal the conductive body, the connecting end of the heating wire, and the connecting ends of the protective sleeve and the core of the conductive wire.

BRIEF DESCRIPTION OF THE DRAWINGS

In drawings which illustrate an embodiment of the invention.

DETAILED DESCRIPTION OF THE PREFERRED EMBODIMENT

Figure 1:
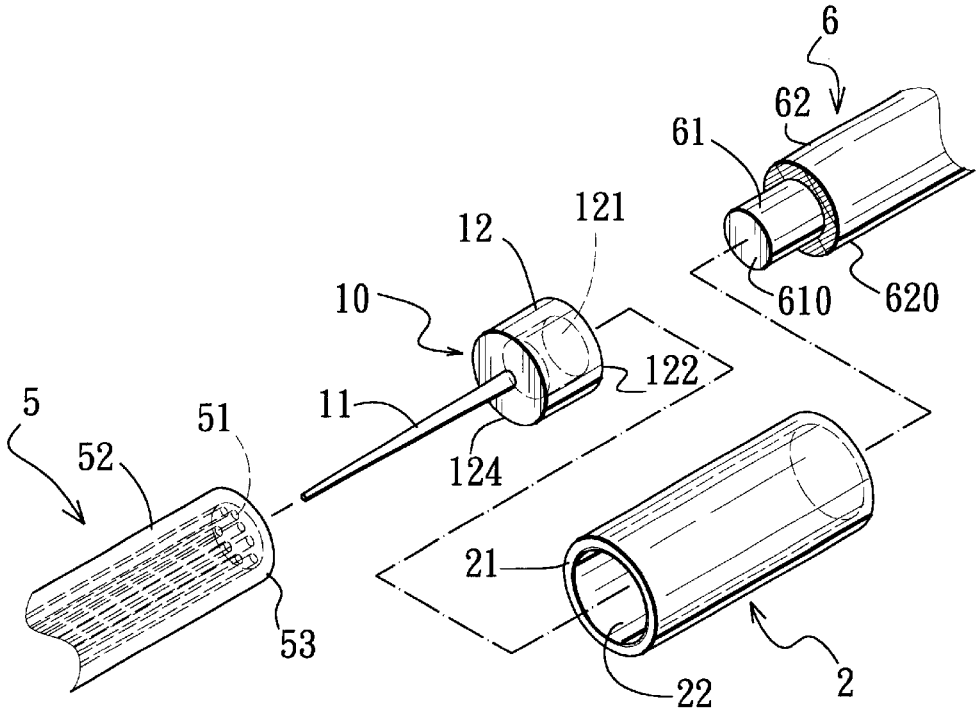
FIG. 1 is a partly exploded perspective view of an electrical heating wire assembly embodying this invention.
Figure 2:
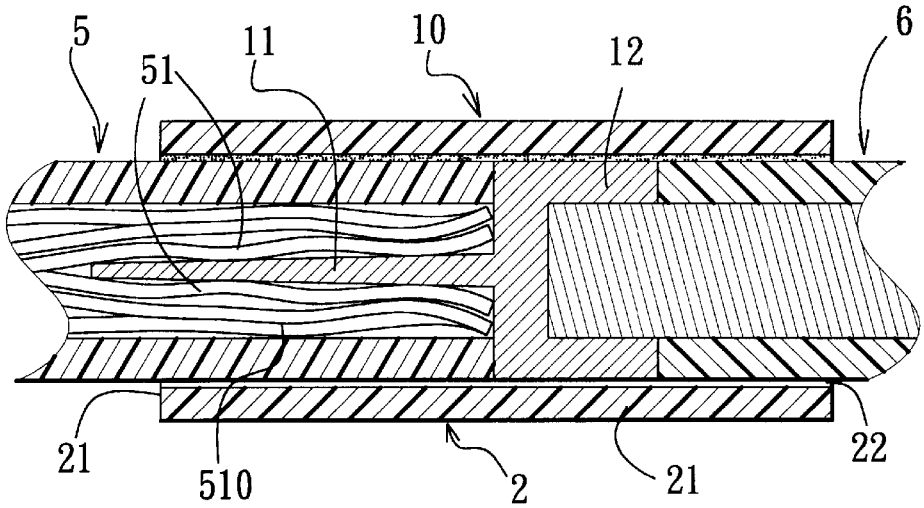
FIG. 2 is a partly sectional view of the electrical heating wire assembly of FIG. 1.

FIGS. 1 and 2 illustrate an electrical heating wire assembly embodying this invention for an electric blanket (not shown). The electrical heating wire assembly includes: an electrical heating wire 5 including a bundle of electrical heating filaments 51 of carbon fiber, and an insulator sleeve 52 that is sleeved on the heating filaments 51, the heating wire 5 having a connecting end 53; an electrical conductive wire 6 including a core 61 and a protective sleeve 62 that is sleeved on the core 61 and that has a connecting end 620, the core 61 having a connecting end 610 that is exposed from the connecting end 620 of the protective sleeve 62; and a connector interconnecting the heating wire 5 and the conductive wire 6, and including a conductive body 10 and an insulator first watertight sleeve 2. The conductive body 10 includes a block portion 12 that extends in a longitudinal direction and that has a conductive wire-connecting end 122, a heating wire-connecting end 124 that is opposite to the conductive wire-connecting end 122, and a recess 121 extending inwardly from the conductive wire-connecting end 122 toward the heating wire-connecting end 124 in the longitudinal direction. The recess 121 receives and is connected to the connecting end 610 of the core 61 of the conductive wire 6. The conductive body 10 further includes a pin portion 11 that is reduced in cross-section relative to the block portion 12, that projects from the heating wire-connecting end 124 in the longitudinal direction, and that is inserted into the insulator sleeve 52 at the connecting end 53 of the heating wire 5 in the longitudinal direction in such a manner that the pin portion 11 of the conductive body 10 is surrounded by the heating filaments 51. The insulator first watertight sleeve 2 extends in the longitudinal direction, is sleeved on the conductive body 10, the connecting end 53 of the heating wire 5, and the connecting end 620 of the protective sleeve 62, and is heat shrinkable so as to seal the conductive body 10, the connecting end 53 of the heating wire 5, and the connecting ends 620, 610 of the protective sleeve 62 and the core 61 of the conductive wire 6. The insulator first watertight sleeve 2 is coated with an adhesive layer 22 on an inner wall thereof for enhancing binding of the insulator first watertight sleeve 2 to the heating wire 5 and the conductive wire 6.

The heating wire-connecting end 124 of the block portion 12 of the conductive body 10 abuts against the connecting end 53 of the heating wire 5. The connecting end 610 of the core 61 is fittingly inserted into the recess 121 in the block portion 12. The conductive wire-connecting end 122 of the block portion 12 abuts against the connecting end 620 of the protective sleeve 62 so as to facilitate assembling of the heating wire 5 and the conductive wire 6.

The first watertight sleeve 2 has a terminating end 21 that is sleeved on the connecting end 53 of the heating wire 5. The pin portion 11 of the conductive body 10 extends outwardly from the heating wire-connecting end 124 of the block portion 12 through the terminating end 21 in the longitudinal direction. In view of this arrangement, electric current flowing at ends 510 of the heating filaments 51, which are surrounded by the furst watertight sleeve 2, can be reduced to a minimum. As such, the heat generated at the connecting end 53 of the heating wire 5 is negligible, thereby eliminating the deteriorating problem with respect to the watertight sleeve as encountered in the prior art.

Figure 3:
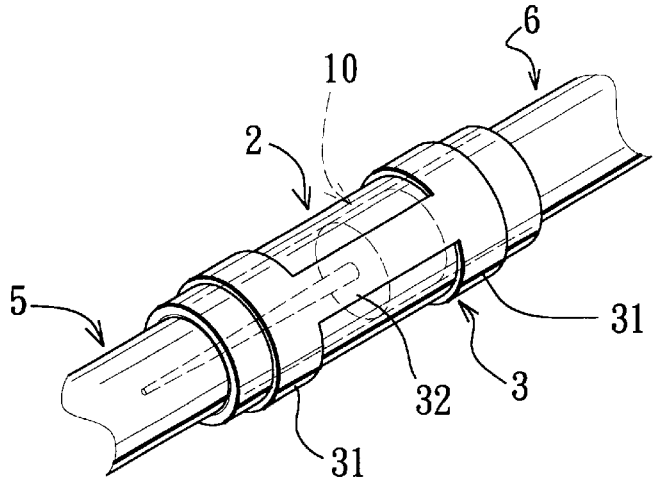
FIG. 3 is a fragmentary perspective view of the electrical heating wire assembly of FIG. 1, with a tightening member being sleeved on a first watertight sleeve.

Referring to FIG. 3, in combination with FIGS. 1 and 2, a tightening member 3 includes two opposing hoops 31 which are sleeved tightly on the first watertight sleeve 2, and a link 32 interconnecting the hoops 31.

Figure 4:
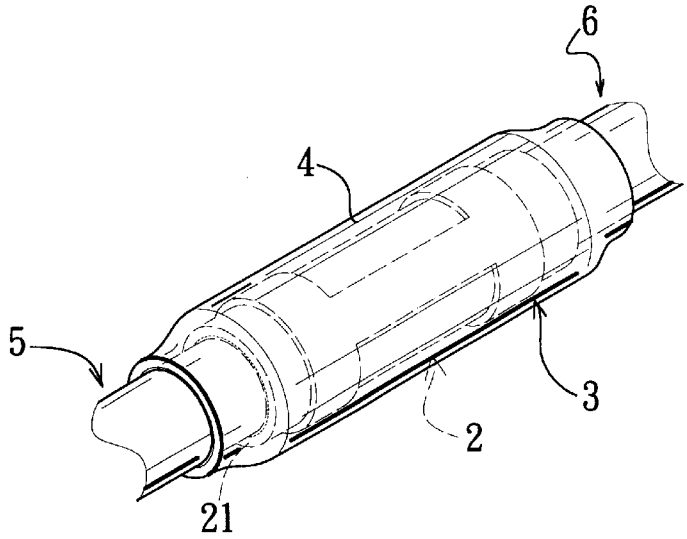
FIG. 4 is a fragmentary perspective view of the electrical heating wire assembly of FIG. 1 with a second watertight sleeve being sleeved on the tightening member.

Referring to FIG. 4, in combination with FIGS. 1 to 3, a second watertight sleeve 4 is sleeved on the tightening member 3, the first watertight sleeve 2, the connecting end 53 of the heating wire 5, and the connecting end 620 of the protective sleeve 62 of the conductive wire 62 so as to enhance sealing of the conductive body 10, the connecting end 53 of the heating wire 5, and the connecting end 620 of the protective sleeve 62.

The design of the pin portion 11 and the block portion 12 of the conductive body 10 is simple, and greatly facilitates assembling of the heating wire 5 and the conductive wire 6.

With the invention thus explained, it is apparent that various modifications and variations can be made without departing from the spirit of the present invention. It is therefore intended that the invention be limited only as recited in the appended claims.

I claim:

1. An electrical heating wire assembly comprising:

an electrical heating wire including a bundle of electrical heating filaments and an insulator sleeve that is sleeved on said heating filaments, said heating wire having a connecting end;

an electrical conductive wire including a core and a protective sleeve that is sleeved on said core and that has a connecting end, said core having a connecting end that is exposed from said connecting end of said protective sleeve; and a connector interconnecting said heating wire and said conductive wire and including a conductive body and an insulator watertight sleeve, said conductive body including a block portion that extends in a longitudinal direction and that has a conductive wire-connecting end, a heating wire-connecting end opposite to said conductive wire-connecting end, and a recess extending inwardly from said conductive wire-connecting end toward said heating wire-connecting end in the longitudinal direction, said recess receiving and being connected to said connecting end of said core of said conductive wire, said conductive body further including a pin portion that is reduced in cross-section relative to said block portion, that projects from said heating wire-connecting end in the longitudinal direction, and that is inserted into said insulator sleeve at said connecting end of said heating wire in the longitudinal direction, said insulator first watertight sleeve extending in the longitudinal direction and being sleeved on said conductive body, said connecting end of said heating wire, and said connecting end of said protective sleeve so as to seal said conductive body, said connecting end of said heating wire, and said connecting ends of said protective sleeve and said core of said conductive wire.

2. The electrical heating wire assembly of claim 1, wherein said pin portion of said conductive body is surrounded by said heating filaments.

3. The electrical heating wire assembly of claim 2, wherein said heating wire-connecting end of said block portion of said conductive body abuts against said connecting end of said heating wire, said connecting end of said core being fittingly inserted into said recess in said block portion, said conductive wire-connecting end of said block portion abutting against said connecting end of said protective sleeve.

4. The electrical heating wire assembly of claim 3, wherein said first watertight sleeve has a terminating end that is sleeved on said connecting end of said heating wire, said pin portion of said conductive body extending outwardly from said heating wire-connecting end of said block portion through said terminating end in the longitudinal direction.

5. The electrical heating wire assembly of claim 4, further comprising a tightening member that includes two opposing hoops which are sleeved tightly on said first watertight sleeve, and a link interconnecting said hoops.

6. The electrical heating wire assembly of claim 5, further comprising a second watertight sleeve that is sleeved on said tightening member, said first watertight sleeve, said connecting end of said heating wire, and said connecting end of said protective sleeve of said conductive wire so as to enhance sealing of said conductive body, said connecting end of said heating wire, and said connecting end of said protective sleeve.

7. A connector adapted to interconnect an electrical heating wire and an electrical conductive wire, the heating wire including a bundle of electrical heating filaments and an insulator sleeve that is sleeved on the heating filaments, the heating wire having a connecting end, the conductive wire including a core and a protective sleeve that is sleeved on the core and that has a connecting end, the core having a connecting end that is exposed from the connecting end of the protective sleeve, said connector comprising:

a conductive body including a block portion that extends in a longitudinal direction and that has a conductive wire-connecting end, a heating wire-connecting end opposite to said conductive wire-connecting end, and a recess extending inwardly from said conductive wire-connecting end toward said heating wire-connecting end in the longitudinal direction and adapted to receive and to be connected to the connecting end of the core of the conductive wire, said conductive body further including a pin portion that is reduced in cross-section relative to said block portion, that projects from said heating wire-connecting end in the longitudinal direction, and that is adapted to be inserted into the insulator sleeve at the connecting end of the heating wire in the longitudinal direction; and an insulator watertight sleeve that extends in the longitudinal direction, that is sleeved on said conductive body, and that is adapted to be sleeved on the connecting end of the heating wire and the connecting end of the protective sleeve so as to seal said conductive body, the connecting end of the heating wire, and the connecting ends of the protective sleeve and the core of the conductive wire.

* * * * *